US009417607B2

(12) United States Patent
Sakurai

(10) Patent No.: US 9,417,607 B2
(45) Date of Patent: Aug. 16, 2016

(54) IMAGE FORMING APPARATUS

(71) Applicant: CANON KABUSHIKI KAISHA, Tokyo (JP)

(72) Inventor: Takanori Sakurai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/608,437

(22) Filed: Jan. 29, 2015

(65) Prior Publication Data

US 2015/0241841 A1 Aug. 27, 2015

(30) Foreign Application Priority Data

Feb. 27, 2014 (JP) ..... 2014-036240

(51) Int. Cl.
*G03G 21/20* (2006.01)

(52) U.S. Cl.
CPC ..... *G03G 21/206* (2013.01); *G03G 21/20* (2013.01)

(58) Field of Classification Search
CPC ..... G03G 21/206; G03G 21/20
USPC ..... 399/92
See application file for complete search history.

(56) References Cited

U.S. PATENT DOCUMENTS

2012/0237229 A1* 9/2012 Okamoto ..... 399/33
2012/0301159 A1 11/2012 Takahashi
2012/0308256 A1* 12/2012 Suzuki ..... 399/92
2013/0177332 A1* 7/2013 Saito ..... G03G 15/2021 399/92

FOREIGN PATENT DOCUMENTS

JP 2007-322539 A 12/2007
JP 2012-247503 A 12/2012

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes a developing device; a temperature detecting unit measuring a temperature of a main body; a cooling unit cooling the inside of the image forming apparatus; and a controller controlling the cooling unit based on result of the temperature detecting unit. The controller increases an air flow rate of the cooling unit such that the air flow rate is higher than a predetermined rate if the result of the temperature detecting unit is higher than a first temperature during non image forming and the controller increases an air flow rate of the cooling unit such that the air flow rate is higher than the predetermined rate if the result of the temperature detecting unit is higher than a second temperature which is higher than the first temperature during an image forming operation.

20 Claims, 10 Drawing Sheets

IMAGE FORMING APPARATUS

BACKGROUND OF THE INVENTION

1. Field of the Invention

The present invention relates to an image forming apparatus which forms an image by an electrophotographic method such as a copying machine and a printer, in particular to an image forming apparatus having a cooling portion for preventing a temperature rise in the apparatus.

2. Description of the Related Art

When an image forming apparatus operates continuously, a temperature of parts of the apparatus rises. Parts of which temperature rises include a developing device where a friction heat is easily produced by toner agitation, a fixing device for fixing toner to a sheet, a power supply, a motor unit, and the like.

Currently, a toner having thermal fixing property is generally used. When dealing with toner of heat fixing type, a temperature suitable for optimally forming an image before fixing is necessary and acceptable temperature range is generally narrow. Therefore, when the temperature of the toner is increased by the influence of frictional heat of the toner itself and a temperature rise of the parts in the apparatus, a print may be degraded due to a low charge amount of the toner and a low image density.

For this kind of thermal management, U.S. Patent Application Publication No. 2012/0301159 A1 discloses that a toner temperature sensor is set up in the apparatus and during image formation, image density and so on is controlled by adjusting the charge amount of the toner depending on a detected temperature rise of the toner.

However, in recent years, downsizing and cost reduction of image forming apparatuses are progressing and it has been difficult to provide a toner temperature sensor for directly detecting the temperature of the toner in view of space and costs. Therefore, in recent years, as described in Japanese Patent Laid-Open No. 2007-322539, a temperature detecting sensor is disposed at a place to which the temperature of toner is indirectly transmitted and the temperature of the toner is predicted by using a prediction equation based on the temperature of the place.

However, when placing a toner temperature sensor away from the toner as described in Japanese Patent Laid-Open No. 2007-322539, it takes time for the heat of the toner to transmit and reach the sensor. As a result, a temperature change detected by the sensor follows an actual temperature change of the toner with delay.

For example, in the case where a temperature difference between the inside of the apparatus and the outside air due to a temperature rise of the toner inside the image forming apparatus during a long time continuous printing, when air flow rate of a cooling fan is increased in order to cool the toner, flowing of the outside air of relatively low temperature into the apparatus increases. Then, a temperature change of the toner becomes gentle. At this time, the toner temperature detecting sensor follows an actual temperature change of the toner with delay. Thus, an error occurs between the temperature predicted from the detection results of the sensor and the actual temperature.

When the error occurs, the controlling in accordance with the image temperature as described in U.S. Patent Application Publication No. 2012/0301159 A1 is difficult. For example, a large image density change occurs on a replication print of the same original when a flow rate of the cooling fan changes. Because of this, a quality difference occurs among the prints which are printed at the same time or productivity of prints is lowered by adjusting images in order to prevent the quality difference. Thus, in the prior art, there is a problem that maintaining both quality and productivity is difficult.

When this quality difference occurs in prints of the same original, a user may easily recognize it even if the difference is slight. However, when a large air flow rate is set in advance to prevent the quality difference, anticipating a large safety factor, operating noise and power consumption are increased. Further, in this case, switching an air flow rate with the provision of a temperature detecting sensor is meaningless.

SUMMARY OF THE INVENTION

An object of the present invention is to suppress the difference in quality among prints as well as to maintain productivity by suppressing the difference between the predicted temperature and the actual temperature when air flow rate of the cooling fan is changed.

A representative configuration of the present invention for achieving the above object is an image forming apparatus, comprising:

an image bearing member;

a developing device which supplies toner to an electrostatic latent image formed on the image bearing member;

a first temperature detecting unit which measures an ambient temperature of the developing device;

a second temperature detecting unit which measures an atmospheric temperature of a main body of the image forming apparatus;

a cooling unit which cools the inside of the image forming apparatus by blowing; and a controller which controls an operation of the cooling unit based on detection results of the first temperature detecting unit and the second temperature detecting unit, wherein when the detection result of the second temperature detecting unit remains the same temperature, the controller increases an air flow rate of the cooling unit such that the air flow rate is equal to or higher than a predetermined rate if the detection result of the first temperature detecting unit is equal to or higher than a first temperature during a non image forming operation and the controller increases an air flow rate of the cooling unit such that the air flow rate is equal to or higher than the predetermined rate if the detection result of the first temperature detecting unit is equal to or higher than a second temperature which is higher than the first temperature during an image forming operation.

Further features of the present invention will become apparent from the following description of exemplary embodiments with reference to the attached drawings.

DESCRIPTION OF THE EMBODIMENTS

Figure 1:
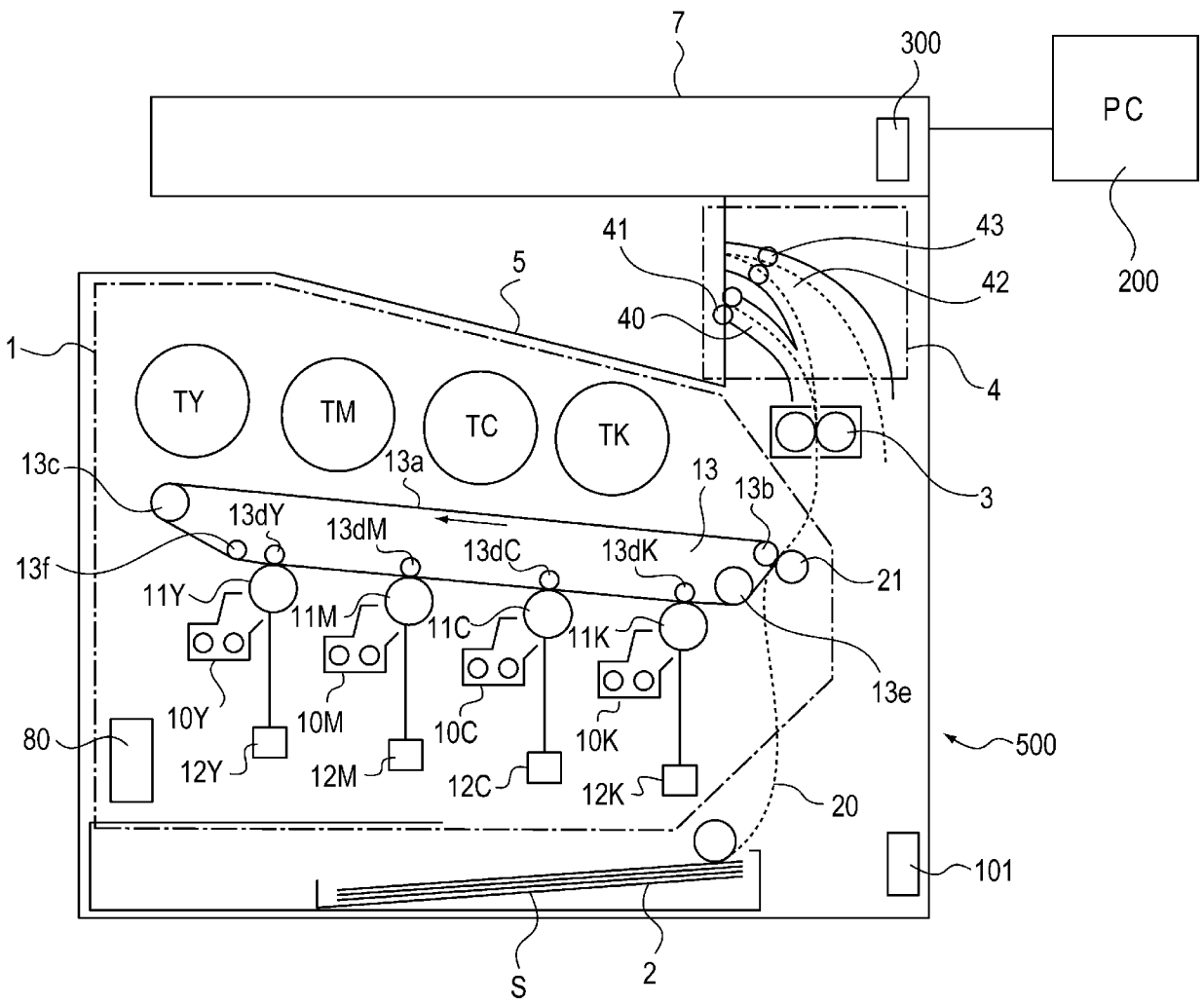
FIG. 1 is a cross-sectional view of the main body of a full-color laser image forming apparatus.

Preferred embodiments of the present invention will be described in detail referring to the drawings. However, dimensions, materials, shapes and relative positions of the components described in the following embodiments are to be appropriately changed depending on the configuration and various conditions of the apparatus to which the present invention is applied. Therefore, unless specifically stated, it is not intended to limit the scope of the present invention to them.

Image Forming Apparatus

An embodiment of an image forming apparatus of the present invention will be described with reference to figures. FIG. 1 is a sectional view of a full-color laser image forming apparatus. The main body (apparatus main body) of the image forming apparatus 500 has an image forming unit 1 for forming a toner image.

The image forming unit 1 is of a four drum full color type. The image forming unit 1 has the process cartridges 10 (10Y, 10M, 10C and 10K) for forming a toner image of four colors including yellow (Y), magenta (M), cyan (C) and black (K). The configurations for forming toner images of these colors are similar and an explanation will be made by omitting suffixes Y, M, C and K except when necessary.

Other than the image forming unit, the main body of the image forming apparatus 500 has the feeding device 2 for feeding the sheet S to the image forming unit 1, the fixing device 3 constituting a fixing unit, the discharging unit 4 for conveying and discharging the sheet after fixing, the sheet stacking unit 5 for stacking the discharged sheets and the original reading device 7 for reading an original.

Then, detail configurations of the respective parts will be described from the image forming unit 1. The image forming unit 1 has fresh toner storing portions FT (FTY, FTM, FTC and FTK) which correspond to process cartridges (developing devices) 10, respectively.

The process cartridge 10 has the photosensitive drum 11 (image bearing member) and the following process means acting on the photosensitive drum 11. The process means includes a charging unit (not shown) for charging the photosensitive drum 11 by applying a predetermined voltage thereto and a developing unit (not shown) for developing an electrostatic latent image formed on the photosensitive drum 11 by adhering toner to the electrostatic latent image. A cleaning unit (not shown) is provided for cleaning toner which has not been transferred on the photosensitive drum 11

The laser scanner 12 is disposed under the process cartridge 10. The laser scanner 12 draws an electrostatic latent image on the photosensitive drum 11. The intermediate transfer unit 13 is disposed above the process cartridge 10. The intermediate transfer unit 13 includes the intermediate transfer belt 13*a*, the driving roller 13*b*, the tension roller 13*c*, the four primary transfer rollers 13*d* to make the intermediate transfer belt 13*a* in contact with the photosensitive drum 11, the idler roller 13*e* and the idler roller 13*f*.

The intermediate transfer belt 13*a* is formed of a film-like member and is rotated in the direction of the arrow by the driving force of the driving roller 13*b*. Application of a predetermined transfer bias by the primary transfer roller 13*d* sequentially transfers each color toner image on the photosensitive drum 11 to the intermediate transfer belt 13*a* on a multiple fashion. As a result, a full-color toner image is formed on the intermediate transfer belt 13*a*.

In parallel to this toner image forming operation, the sheet S is fed by the feeding device 2 and is conveyed to the sheet conveying path 20. Skew feeding correction of the sheet S is performed by a registration roller (not shown) provided in the sheet conveying path 20 and the sheet S is aligned with the toner images on the intermediate transfer belt 13*a*.

After the alignment, the sheet S is fed to the secondary transfer portion formed by a nip between the secondary transfer outer roller 21 and the driving roller 13*b*. At the secondary transfer portion, by the secondary transfer bias applied to the secondary transfer outer roller 21, the toner image is transferred from the intermediate transfer belt 13*a* to the sheet S.

Then, the sheet S is conveyed by the driving force of the driving roller 13*b* and is fed to the fixing device 3. Heat and pressure is added to the sheet S which is sent to the fixing device 3, thereby color toner is melted and a full color visible image is fixed on the sheet S.

The discharge portion 4 is disposed above the fixing device 3. The discharge portion 4 has the discharge passage 40, the discharge roller pair 41, the both sides reversing path 42 and the reverse roller pair 43. The sheet discharged from the discharge portion 4 is stacked with the image side down in the sheet stacking portion 5.

The second sensor 101 (second temperature detection unit) is provided at the front portion of the main body of the image forming apparatus 500 for measuring an ambient temperature of the main body of the image forming apparatus 500. Data of installation environment temperature detected by the second sensor 101 are used for air flow rate control of the cooling fan 80 (cooling portion) which cools the interior of the apparatus by blowing and image formation control such as toner density control.

Next, an image forming operation of the image forming apparatus 500 will be explained. Firstly, the image data read by the original reading device 7 is transmitted to the controller 300 and the image data are stored as image information.

In the image forming unit 1, the surface of the photosensitive drum is uniformly charged to a predetermined polarity and potential by a charging unit (not shown). Then, a laser beam is emitted from the laser scanner 12 on the basis of the image information stored in the control unit 300. The emitted laser beam is scanned over the photosensitive drum 11; thereby an electrostatic latent image is formed on the photosensitive drum 11.

Thereafter, toner is supplied to the electrostatic latent image from the developing unit supplied with fresh toner by the fresh toner reservoir FT; thereby an electrostatic latent image is developed and a toner image is obtained. The development of the electrostatic latent image is carried out at a developing position, that is, at the developing nip formed where the photosensitive drum 11 and the developing sleeve are opposed.

The developer in which toner and carrier are mixed with a predetermined ratio is accommodated in the developing unit of the process cartridge 10. The toner and carrier are frictionally charged by a stirring screw and are provided to a developing sleeve. The developing unit has a regulating blade (not shown) for making the thickness of the developer coated on the developing blade a predetermined value. Thus, the developer having a predetermined thickness in which toner and carrier are mixed is coated on the developing sleeve.

The toner image borne on the photosensitive drum 11 by the developing sleeve is conveyed to the primary transfer portion of the contact portion between the intermediate transfer belt 13*a* and the photosensitive drum 11 with the rotation of the photosensitive drum 11. A primary transfer bias is applied to the primary transfer roller 13*d*. Therefore, the toner image is transferred to the intermediate transfer belt 13*a* at the primary transfer portion. The operation is sequentially performed in the four process cartridges 10. Then, a full-color toner image is formed by multiply transferring toner images on the intermediate transfer belt 13*a*. Toner which remains without being transferred is scraped from the photosensitive drum surface by a cleaning unit (not shown) of the image forming unit.

Factors that cause the temperature of the image forming unit 1 to increase include frictional heat between the bearing which supports the photosensitive drum 11 and the photosensitive drum 11 and frictional heat generated by rubbing of the photosensitive drum 11 and the cleaning unit. Other factors include frictional heat of the bearings for supporting the screw which charges the developing sleeve and the developer and supplies toner to the sleeve and frictional heat generated between the developing sleeve and the photosensitive drum 11.

Therefore, the explanation will be made to the image forming unit 1 which has the photosensitive drum 11, the cleaning unit, the developing sleeve, the developing screw, the bearings for support, and the developing container for containing the toner in the developing unit.

Cooling of the Process Cartridge

Figure 2:
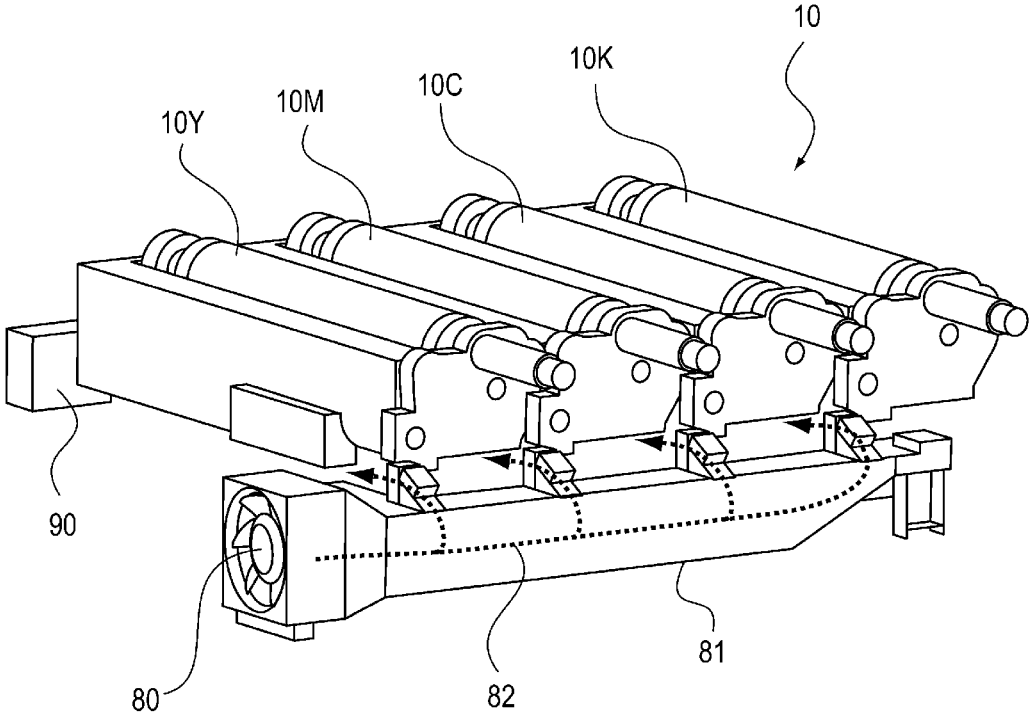
FIG. 2 is a schematic diagram of the cooling system of the process cartridge.
Figure 3:
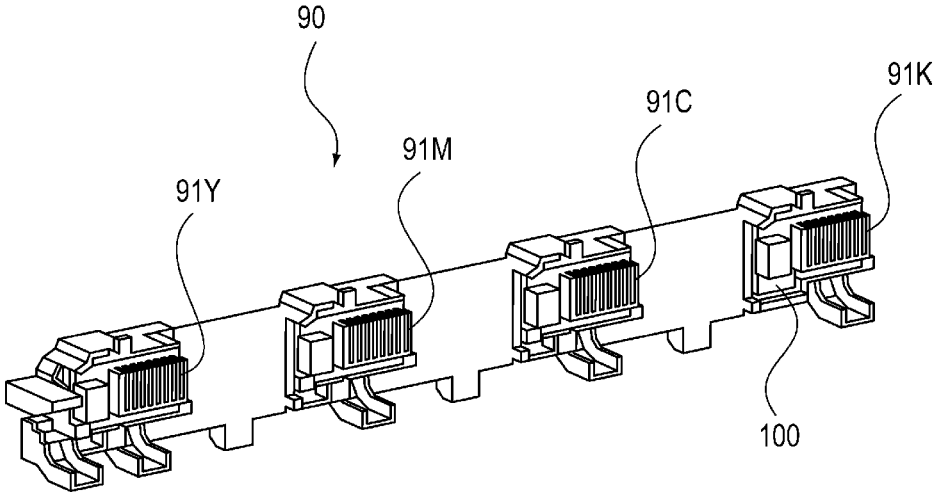
FIG. 3 is a detailed diagram of a contact part of the process cartridge having an internal sensor.

An arrangement of the temperature detecting unit having a characteristic configuration of this embodiment and a cooling method of the process cartridge 10 will be explained with reference to figures. FIG. 2 is a schematic diagram showing a method of cooling the process cartridge. FIG. 3 is a detailed view of a contact portion of the process cartridge having an internal sensor.

As shown in FIG. 2, the cooling fan 80 is a suction fan for taking the outside air into the inside of the apparatus. The outside air taken by the cooling fan 80 flows into the duct 81. The duct 81, as indicated by the arrow 82, is configured to guide the outside air to the lower surface of each process cartridge 10. Thus, by taking the outside air by the cooling fan 80 to form a flow of air, and by introducing it to the lower surface of the process cartridge 10, the toner in the process cartridge 10 is indirectly cooled.

A memory tag (not shown in FIG. 2) is mounted on the rear surface of the process cartridge 10. The contact portion 90 of the image forming apparatus is in contact with the memory tag. As shown in FIG. 3, the contact portion 90 has the contact boards 91 (91Y, 91M, 91C, 91K). The memory tag records individual information for each process cartridge 10, such as a number of used sheets. The image forming apparatus 500 receives the information of each process cartridge 10 from the memory tag through each contact substrate 91.

As shown in FIG. 3, the first sensor 100 (first temperature detector) is disposed on the contact substrate 91K for black color and measures the ambient temperature of the process cartridge 10. The first sensor 100 is disposed outside the process cartridge and is adjacent to the process cartridge 10. Thus, the first sensor 100 is never in contact with the toner in the process cartridge 10 and it does not detect the toner temperature directly. A toner temperature is predicted by using the toner temperature prediction method which will be described later based on the temperature detected by the first sensor 100.

Cooling Fan and Image Formation Control

Figure 4:
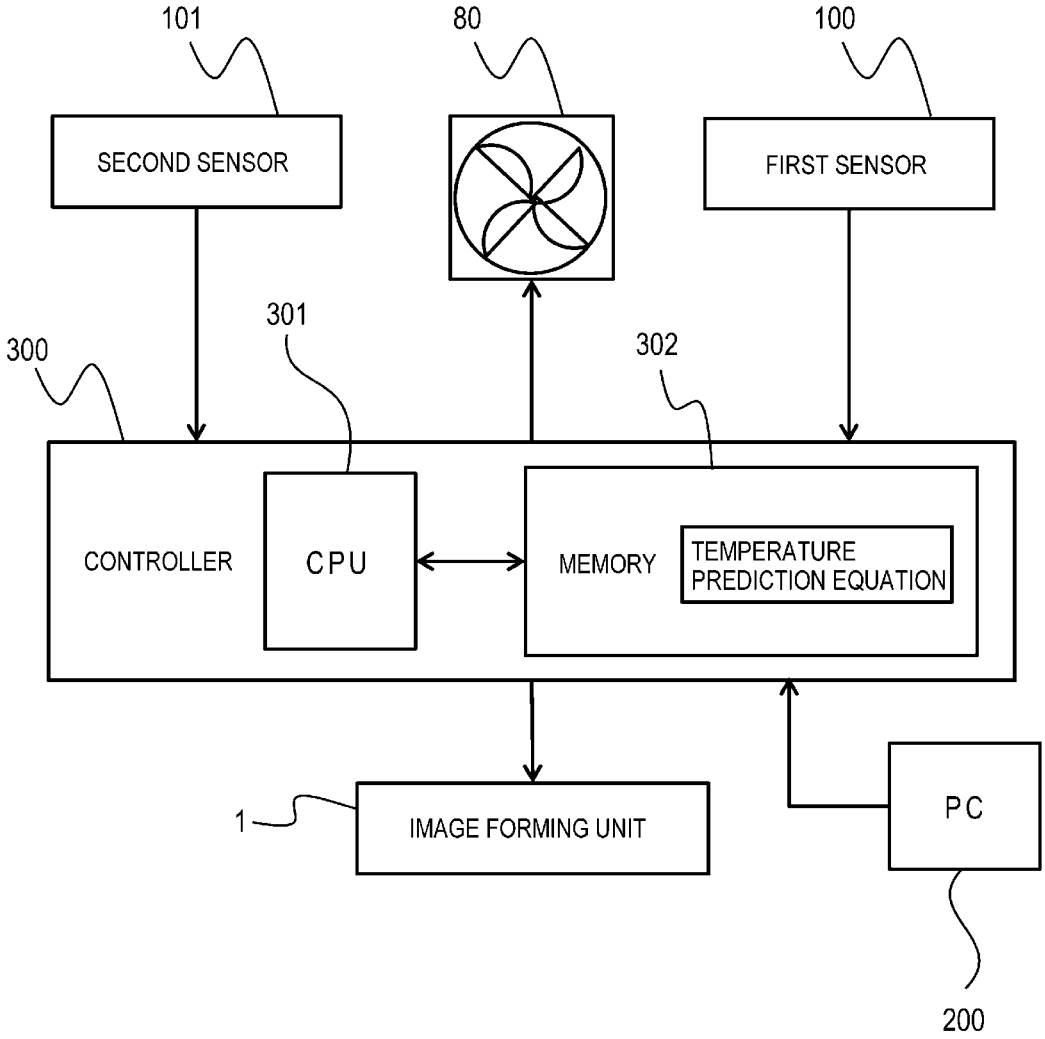
FIG. 4 is a block diagram of a controller.

The control of the cooling fan will be described with reference to figures. FIG. 4 is an explanatory diagram of the controller. The image forming apparatus 500 performs an image formation control such as an image density control of the image forming unit 1 and an air flow rate control of the cooling fan 80 based on the results of the toner temperature prediction control.

As shown in FIG. 4, the controller 300 comprising the CPU 301 and the memory 302 issues an instruction of the image forming operation of the main body of the image forming apparatus 500 and controls the cooling fan 80. Detected temperature signals from the first sensor 100 and the second sensor 101 and a print job from the external PC 200 are input to the controller 300.

The temperature prediction equation including temperatures detected by the first sensor 100 and the second sensor 101 is stored in the memory 302. The temperature prediction equation is used for calculating the predicted temperature T from the detected temperature Ts of the first sensor 100 and the detected temperature Te of the second sensor 101.

The CPU 301 calculates the predicted temperature T using the stored temperature prediction equation and thereafter issues an instruction of the command value of the rotational speed (air flow rate) of the cooling fan 80 and an instruction of the image formation control such as image density control.

In this embodiment, an input voltage to the cooling fan 80 is virtually controlled by using a PWM control which can vary pulse modulation width. During the image forming operation, the air flow rate of the cooling fan 80 is selected from three stages of M0 (zero air flow rate), M1 (half of the maximum air flow rate of the fan) and M2 (the maximum air flow rate of the fan) in the order of magnitude of the air flow rate.

When the toner temperature predicted by the prediction equation described below is less than or equal to a previously defined threshold value, the air flow rate of the cooling fan 80 is made zero for suppressing noise of the operation sound of the fan. Conversely, when the toner temperature increases and exceeds a predetermined threshold temperature, the air flow rate of the cooling fan 80 is increased for suppressing temperature rise of the toner. Further, the image formation control adjusts the charge amount of the toner at all times based on the results of the toner temperature prediction.

Toner Temperature Prediction

Figure 5:
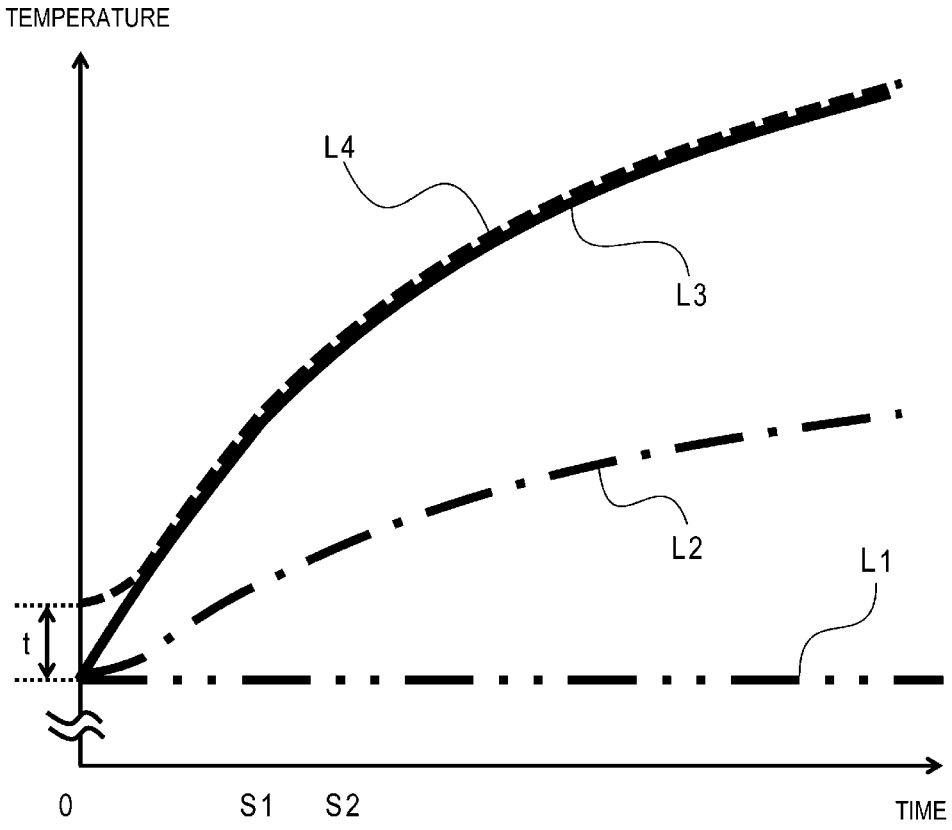
FIG. 5 is a graph showing transition of the temperature of toner during image formation when an air flow rate of the cooling fan is not changed.

The prediction equation of the toner temperature of this embodiment will be described. FIG. 5 is a graph showing changes in the toner temperature at the time of image formation when the air flow rate of the cooling fan is not changed. In FIG. 5, the state of the image forming apparatus 500 during a printing operation is indicated when the air flow rate of the cooling fan 80 is not changed. Specifically, the transition (L1) of the detected temperature Te of the second sensor 101, the transition (L2) of the detected temperature Ts of first sensor 100, the transition (L3) of the actual temperature of the toner of the inside of the process cartridge and the transition (L4) of prediction temperature T are shown. Note that the predicted temperature T of the toner is a value obtained by predicting the actual temperature of the toner from the values of the temperature sensors. The vertical axis represents the toner temperature, and the horizontal axis represents the print time.

In FIG. 5, the detected temperature Te (detection result) of the second sensor 101 is substantially the same temperature. In this case, the temperature T of the toner in the process cartridge 10 of this embodiment is predicted by using the following prediction equation (Equation 1), $$T=\alpha(Ts-Te)+Te+t \quad \text{(Equation 1)}$$

wherein t denotes any offset temperature, α denotes an arbitrary temperature coefficient. The offset temperature t and the temperature coefficient α are determined arbitrarily by the configuration of the image forming apparatus. In this embodiment, t=2° C., α=2. However, the prediction equation has been created based on the configuration of this embodiment and is not intended to limit the scope of the invention.

The second sensor 101, as shown in FIG. 1, is disposed at a position away from the toner in the process cartridge. Therefore, a rise in the temperature of the second sensor 101 is lower than that of the actual temperature of the toner in the process cartridge during the same print time. In this case, the toner temperature in the process cartridge 10 is predicted by using the prediction equation (Equation 1).

Figure 6:
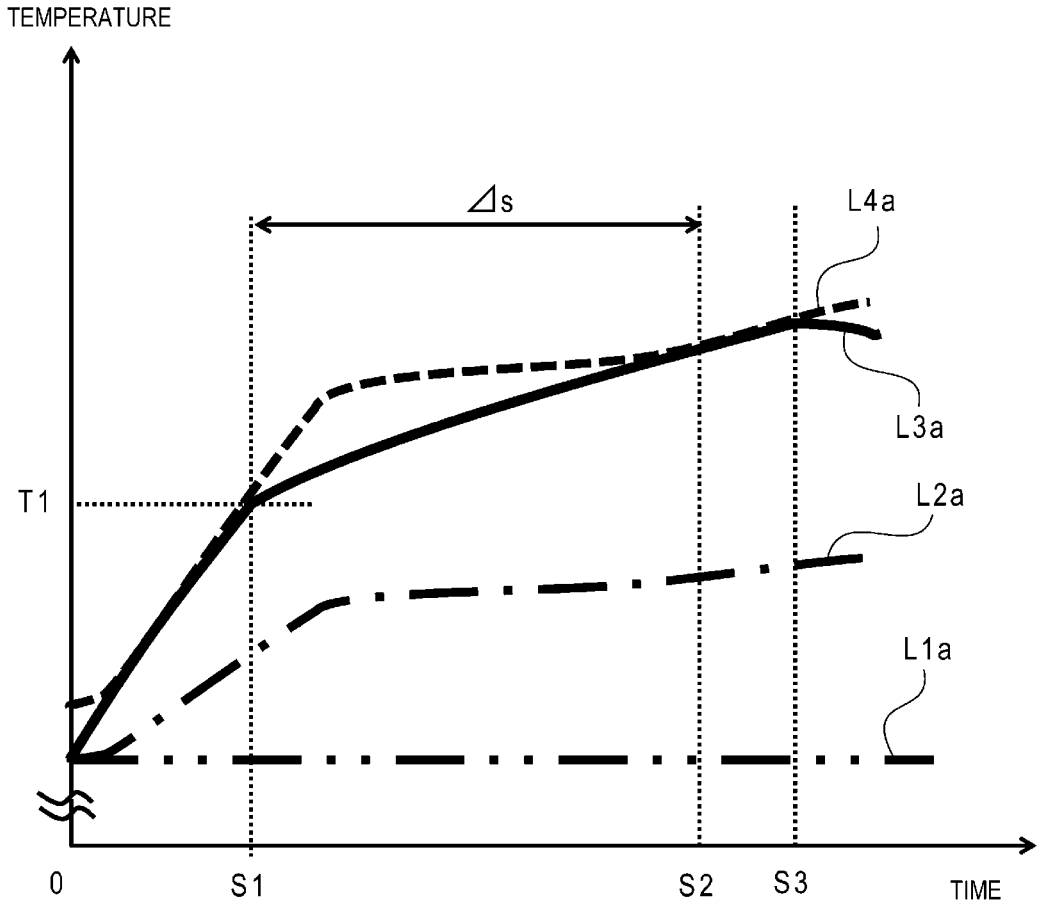
FIG. 6 is a graph showing the difference between an actual temperature and a predicted temperature of the toner during image formation when an air flow rate of the cooling fan is changed.

Mechanism of Detection Errors Occurring Due to Air Flow Rate Control of the Cooling Fan Then the temperature transition of the image forming apparatus in the case of changing the air flow rate of the cooling fan 80 will be described with reference to figures. FIG. 6 is a graph showing the difference between the actual temperature and the predicted temperature of the toner at the time of image formation in the case of changing the air flow rate of the cooling fan. Indicated in FIG. 6 are the transition (L1*a*) of the detected temperature Te of the second sensor 101, the transition (L2*a*) of the detected temperature Ts of the first sensor 100, the transition (L3*a*) of the actual temperature of the toner in the process cartridge and transition (L4*a*) of the predicted temperature T of the toner.

Next, the operation of the image forming apparatus 500 in the case of changing the air flow rate of the cooling fan will be described. The controller 300 of the image forming apparatus 500 receives a print job from the external PC 200 and starts the image forming operation.

In the following description, the start of the image forming operation is set at any timing between reception of a print job and the time when a top edge of an image of the first sheet in the job reaches the development nip. In the present embodiment, the CPU determines the start of the image forming operation in response to the print job. Also, the end of the image forming operation is set at any timing between the time when the last image of the job passes through the development nip and the time when the post-rotation is completed. In the present embodiment, the CPU determines the end of the image forming operation according to a post-rotation end signal.

Until the time S1 shown in FIG. 6, the predicted temperature of the toner is low. Therefore, the cooling fan 80 is stopped and the image formation control for the low-temperature is performed. Thereafter, at time S1 when the predicted temperature of the toner becomes the threshold temperature T1 (the first temperature) during printing, the controller 300 determines that heating of the toner in the process cartridge 10 advances. At this time, the controller 300 increases the air flow rate of the cooling fan 80 to run the apparatus at half the maximum air flow rate. As explained above, the suppression of the toner temperature rise begins. This operation is called an image formation control for medium high temperature. Thereafter, at the time S3, the image forming operation of the print job received from the external PC 200 is ended.

As shown in FIG. 6, during the time period (Δs) from the time S1 when the air flow rate of the cooling fan 80 is increased until the time S2, an error occurs between the transition (L3*a*) of the actual temperature and transition (L4*a*) of the predicted temperature. This is because it takes time for the temperature to transfer to the sensor due to the structure where the sensor is disposed away from the toner and a change in temperature detected by the sensor follows with delay in a change in the air flow rate.

If an error occurs between the actual temperature and the predicted temperature as explained above, the image formation control is influenced. As a result, when printing the same content for example, a difference in density and quality of the print occurs before and after the air flow rate changes.

This error appears more remarkably especially when increasing the air flow rate of the cooling fan 80 from the state where the cooling fan 80 is stopped. This is because when a temperature difference between the outside air and the inside air becomes remarkable after a temperature rise by an image forming operation, relatively cold outside air is rapidly introduced into the apparatus by the start of the operation of the cooling fan 80. Namely, relatively cold air rapidly flows into the apparatus, so that the toner is rapidly cooled and a difference between the temperature of the first sensor 100 and that of the second sensor 101 is widened.

Air Flow Rate Control of the Cooling Fan

First Embodiment

Figure 7:
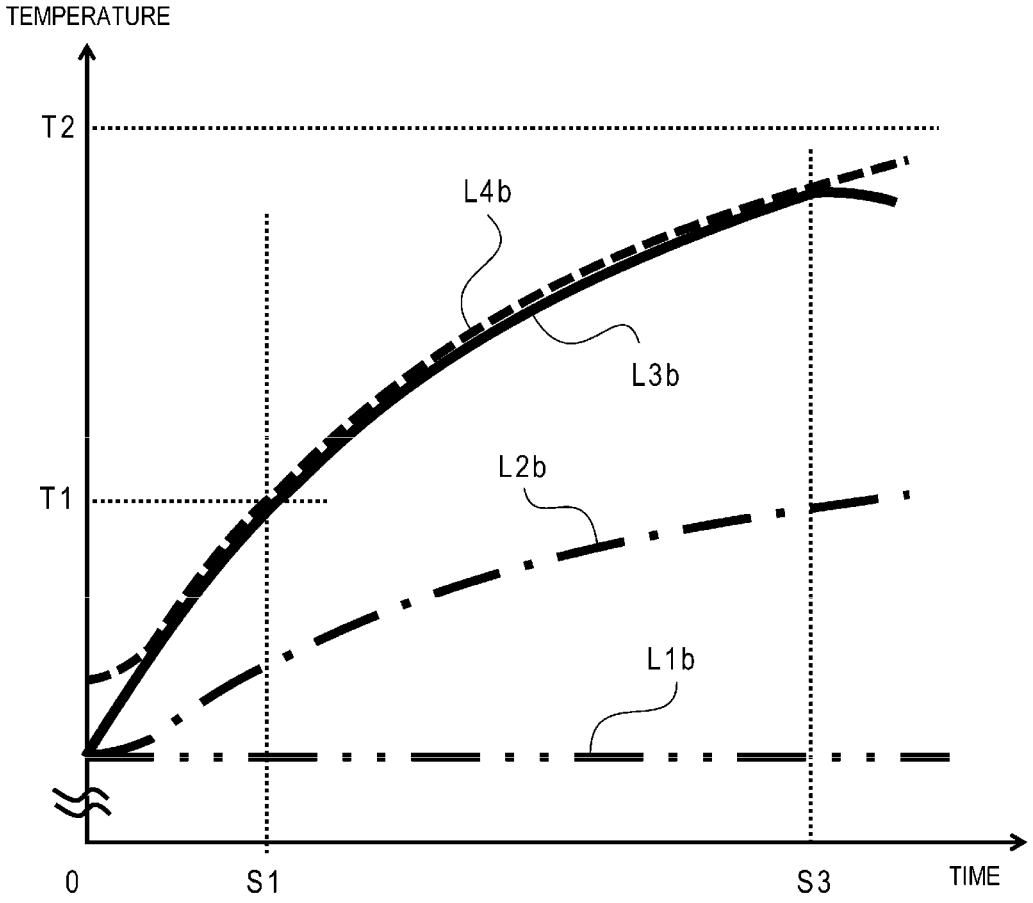
FIG. 7 is a graph showing the difference between an actual temperature and a predicted temperature of the toner when a cooling fan control of the first embodiment is performed.

The next, an embodiment of air flow rate control of the cooling fan 80 which is a feature of the present invention will be described with reference to figures. FIG. 7 is a graph showing a difference between the actual temperature and the predicted temperature of the toner in the case of performing the cooling fan control of the first embodiment. Indicated in FIG. 7 are the transition (L1*b*) in temperature detected by the second sensor 101, the transition (L2*b*) in temperature detected by the first sensor 100, the transition (L3*b*) in the actual temperature of the toner of the process cartridge and the transition (L4*b*) of the temperature T which predicts the actual temperature of the toner.

Figure 8:
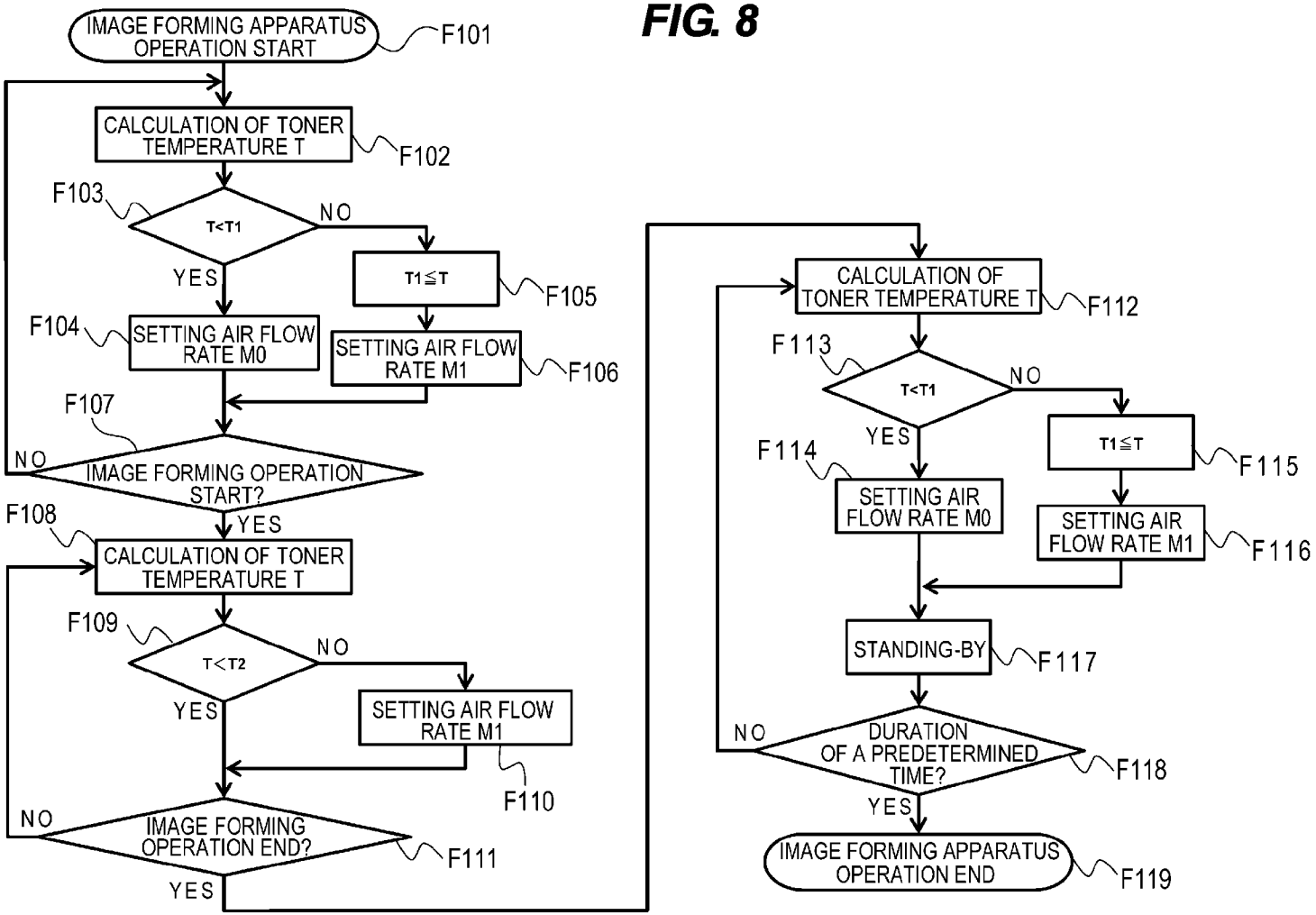
FIG. 8 is a flowchart showing a control of an air flow rate of the cooling fan of the first embodiment.

FIG. 8 is a flowchart showing the air flow rate control of the cooling fan of the first embodiment. As shown in FIG. 8, when running an image forming apparatus 500 (F101), the controller 300 has received a print job from the external PC 200. Thereafter, the controller 300 has received detected temperature signals indicating the detected temperature Ts of the first sensor 100 and the detected temperature Te of the second sensor 101. The CPU 301 of the controller 300 calculates the predicted temperature T of the toner using the prediction equation stored in the memory 302 (F102).

The controller 300 starts the operation of the cooling fan 80 according to the following procedure based on the predicted temperature T by calculation. The threshold temperature T1 as a reference for switching the air flow rate of the cooling fan 80 is set in the controller 300 in advance.

When the predicted temperature T<T1 (F103), it is recognized that the toner temperature has not yet risen, the air flow rate of the cooling fan 80 is set to M0 (zero air flow rate) (F104), thereby suppressing the operation of the cooling fan 80 to a minimum and suppressing the operation sound.

On the other hand, when the predicted temperature T≥T1 (F105), the air flow rate is set to M1 (half of the maximum air flow rate of the fan) and the cooling fan 80 runs at half the maximum air flow rate (F106). This makes it possible to perform adequate cooling of the image forming apparatus 500. As described above, an upper limit of the air flow rate of the cooling fan 80 is provided, thereby suppressing the operation sound of the cooling fan 80. As explained later, the air flow rate is not set to M2 in the present embodiment.

Even after the image forming operation starts, the operation of the image forming apparatus 500 is the same as that of FIG. 6 until the predicted temperature T reaches the threshold temperature T1 (until the time S1). The controller 300 compares the predicted temperature T with the threshold temperature T2 that is set in advance for controlling the air flow rate of the cooling fan 80. The threshold temperature T2 may be set in advance, or it may be changed according to the use of the image forming apparatus.

As shown in the flowchart of FIG. 8, after the image formation operation is started (F107), the predicted temperature T of the toner is calculated again (F108). When T<T2 (F109), the value the setting of the cooling fan 80 is maintained. Thus, the cooling fan control during the image forming operation is suppressed and it is possible to suppress the occurrence of the difference between the actual temperature and the predicted temperature of the toner. On the other hand, unless T<T2, the air flow rate of the cooling fan 80 is set to M1. As a result, it is possible to reduce the difference in quality in the print material and to suppress the air flow.

When the image forming process is terminated (F111), the predicted temperature T of the toner is calculated again (F112). If the predicted temperature T of the toner is less than the threshold temperature T1, the air flow rate is set to M0 (F114). On the other hand, if the predicted temperature T of the toner meets T1≤T (F115), the air flow rate is set to M1 (F116).

Thereafter, the image forming apparatus 500 enters into a standby state (F117) waiting for the next print job while maintaining the fan operation during a predetermined period of time (F118). Then the operation of the image forming apparatus 500 is terminated (F119). When a print job is started again during waiting, the sequence returns to the beginning of the flowchart. If the temperature exceeds the threshold temperature T1 prior to the start of the image formation process, a print operation is performed with the half of the maximum air flow rate of the cooling fan 80. This operation is performed in order to avoid a change in the air flow rate of the fan during printing by increasing the air flow rate prior to the image forming operation.

The temperature setting of the threshold temperatures T1 and T2 can be set as appropriate depending on the situation. For example, the threshold temperature T2 may be set as follows. The maximum number of prints in a single image forming operation from the envisioned number of printed sheets a day is assumed and an amount of the temperature rise at the number of printed sheets is added to the threshold temperature T1.

In the first embodiment, during the period where an image forming operation is not performed prior to an image forming operation, the driving of the cooling fan 80 is started when the temperature is equal to or higher than the threshold temperature (first temperature). On the other hand, during an image forming operation, when the temperature is equal to or higher than the threshold temperature T2 (second temperature) which is higher than the threshold temperature T1, the cooling fan is operated during the image forming operation.

Second Embodiment

Figure 9:
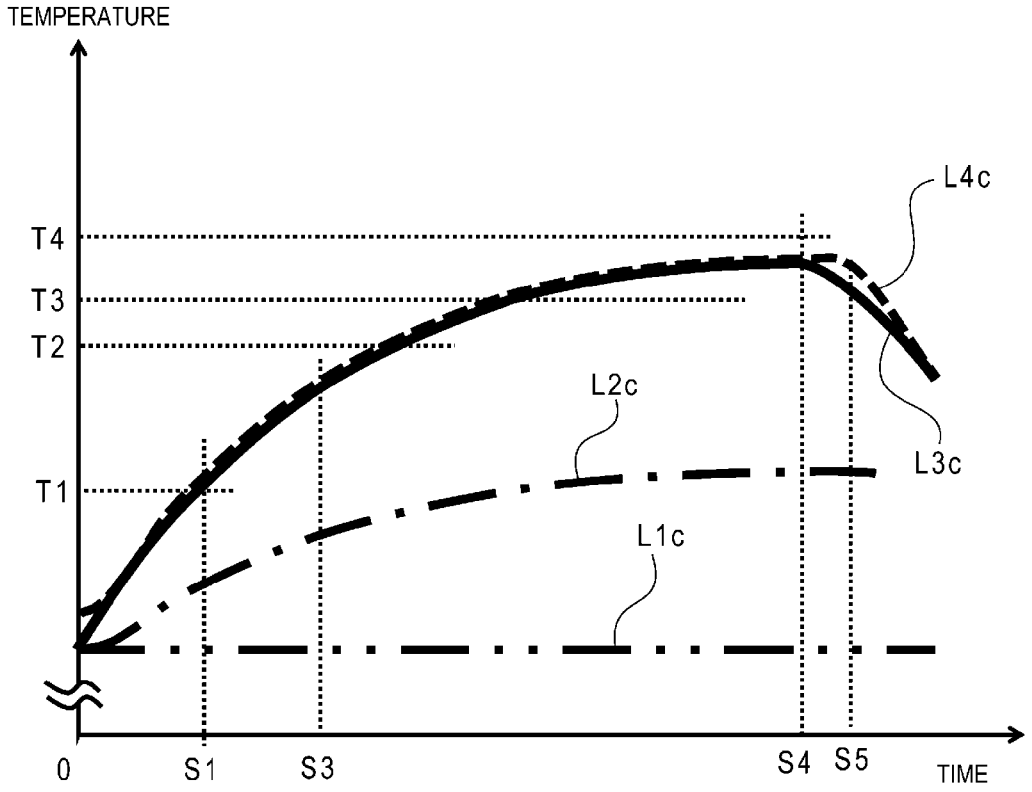
FIG. 9 is a graph showing the difference between an actual temperature and a predicted temperature of the toner when a cooling fan control of the second embodiment is performed.

The air flow rate control of the cooling fan 80 of the second embodiment will be described with reference to figures. FIG. 9 is a graph showing a difference between the actual temperature and the predicted temperature of the toner in the case of performing the cooling fan control of the second embodiment. Indicated in FIG. 9 are the transition (L1*c*) of the temperature detected by the second sensor 101, the transition (L2*c*) of the temperature detected by the first sensor 100, the transition (L3*c*) of the actual temperature of the toner in the process cartridge and the transition (L4*c*) of the predicted temperature which predicts the actual temperature of the toner from values of temperature sensors.

Figure 10:
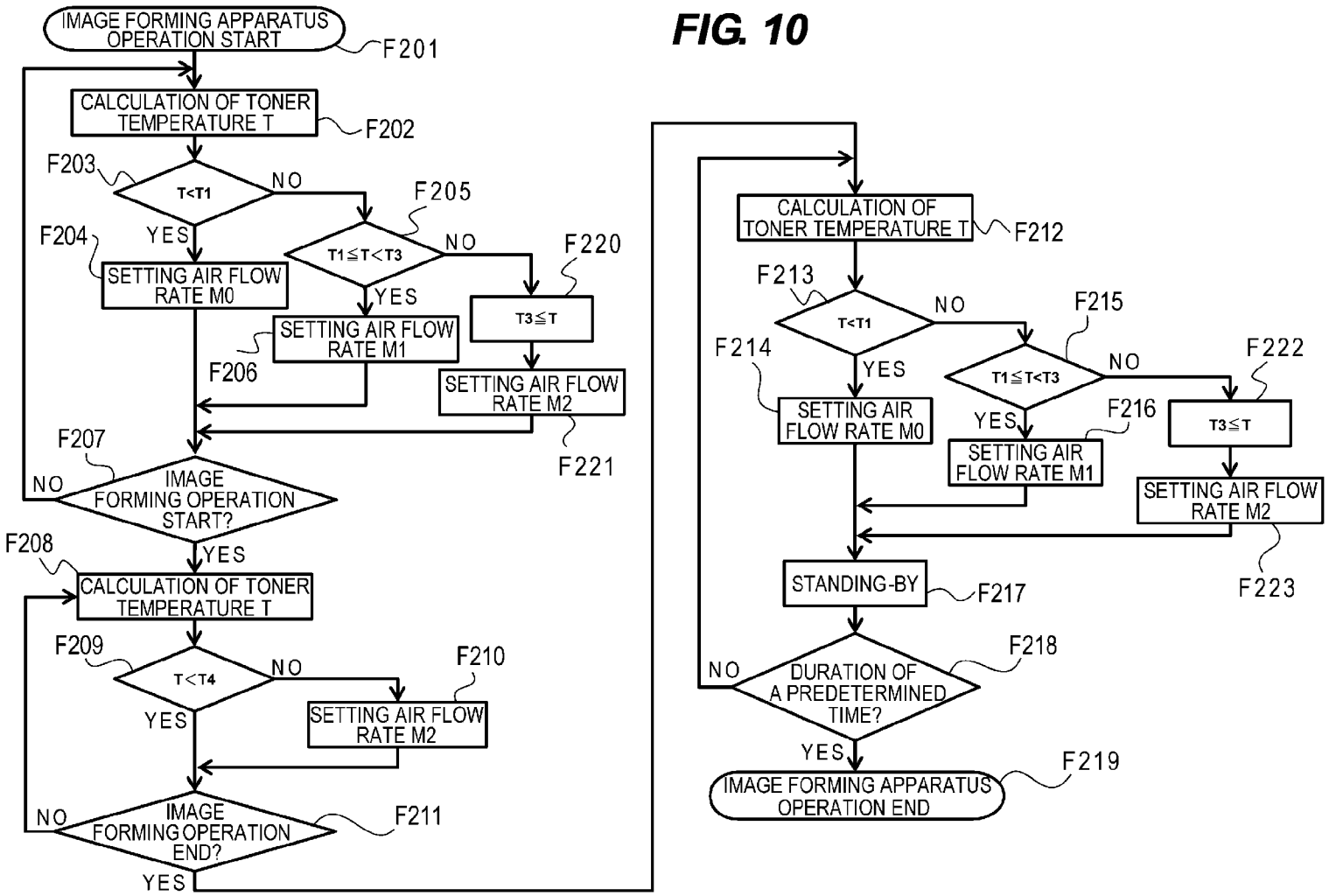
FIG. 10 is a flowchart showing a control of an air flow rate of the cooling fan of the second embodiment.

With reference to the temperature of FIG. 9, the air flow rate control of the cooling fan 80 will be described with reference to FIG. 10. FIG. 10 is a flowchart showing an air flow rate control of the cooling fan of the second embodiment. In the second embodiment, setting of the air flow rate M2 is added to the first embodiment and the air flow rate is selected from three air flow rates. Further, the threshold temperatures T3 and T4 are additionally set.

As shown in FIG. 10, when the operation of the image forming apparatus is started (F201), the controller 300 receives a print job from the external PC 200. Thereafter, the controller 300 receives detected temperature signals indicating the detected temperature Ts of the first sensor 100 and the detected temperature Te of the second sensor 101.

The CPU 301 of the controller 300 calculates the predicted temperature T of the toner on the basis of the detected temperature signal (F202). The calculation of predicted temperature T of the toner is performed using the prediction equation stored in the memory 302 based on the detected temperature signal. The controller 300 controls the operation of the cooling fan 80 based on the calculated predicted temperature of the toner as follows.

When the predicted temperature T<T1 (F203), the controller 300 recognizes that the toner temperature has not yet increased. In this case, the air flow rate of the cooling fan 80 is set to M0 (zero air flow rate) (F204), thereby suppressing the operation of the cooling fan 80 to a minimum and suppressing the operation sound.

When the predicted temperature T meets T1≤T<T3 (F205), the air flow rate is set to M1 (F206) and the cooling fan 80 runs at half the maximum air flow rate. Thus, the cooling of the image forming apparatus is started. Also, when the predicted temperature T meets T3<T (F220), the air flow rate is set to M2 and the cooling fan 80 runs at the maximum air flow rate (F221). Only in this case, the cooling capability of the image forming apparatus is set to be maximum.

Then, the operation of the image forming apparatus 500 after starting the image forming operation is the same as that of FIG. 6 until the predicted temperature T reaches the threshold temperature T1 (until the time S1). Specifically, as shown in the flowchart of FIG. 10, after starting the image forming process (F207), the controller 300 compares the predicted temperature T with the threshold temperature T4 that is set in advance for controlling the air flow rate of the cooling fan 80. The relationship of the threshold temperatures is T1<T3<T4.

Then, during the image formation, the air flow rate of the cooling fan 80 is maintained until the temperature reaches the threshold temperature T4 (F208, F209, F211). Thus, the operation of the cooling fan 80 during the image formation is suppressed. Further, by suppressing the operation of the cooling fan 80, a rapid decrease in the temperature detected by the first sensor 100 is prevented. Therefore, it is possible to suppress the occurrence of the difference between the actual temperature and the predicted temperature of the toner. As a result, it is possible to reduce the difference in quality in the printed material.

When the predicted temperature T exceeds the threshold temperature T4 during image formation processing (F209), the air flow rate of the cooling fan 80 is increased even during printing. In this case, the air flow rate is set to M2 regardless of the previous air flow rate (F210). Thus, if the temperature exceeds the threshold temperature T4, the inside of the apparatus is cooled at the maximum air flow rate of the cooling fan 80. Alternatively, when the previous air flow rate is M0, the air flow rate may be changed in a stepwise way from M1 to M2. In this case, it is sufficient that the threshold temperature of the switching temperature is set to be higher than the temperature during the non image forming.

The threshold temperature T4 is set to be lower than the temperature at which toner aggregates increase due to a temperature rise. This configuration is made in order to prioritize preventing damage of the process cartridge due to toner aggregates generated by high temperature more than maintaining the quality of printed material in the case of the temperature exceeding the threshold temperature T4.

During the image forming process, when the predicted temperature T is lower than the threshold temperature T4, the air flow rate before the image formation is maintained in order to keep the quality of a toner image. Thus, in the present embodiment, a change in the air flow rate in the image forming process is suppressed as much as possible.

Then, when the image processing is temporarily finished (F211), the controller 300 returns the threshold temperatures to T1 and T3. Therefore, when the image processing is completed at the time S4 beyond the time S3 of FIG. 9 (corresponding to the first embodiment), the calculated predicted temperature T of the toner (F212) meets T3≤T. In this case, the air flow rate is set to M2 (F223), and the cooling fan 80 is operated at the maximum air flow rate.

The predicted temperature T is below the threshold temperature T3 at the time S5 shown in FIG. 9. In this case, the predicted temperature T of the present embodiment meets T1≤T≤T3 (F215) and the air flow rate is set to M1 (F216). Namely, the apparatus runs at the half of the maximum air flow rate of the cooling fan 80.

Then, the apparatus enters into a standby state (F217) where the apparatus waits for the next print job while maintaining the fan operation for a predetermined time period (F218). Then, the operation of the image forming apparatus is stopped (F219).

When a print job is in the standby state and is started again, the sequence returns to the top of the flowchart. When, for example, the predicted temperature T (F202) of the toner exceeds the threshold temperature T1 before the image forming process starts (F205), the air flow rate of the cooling fan 80 is set to half of the maximum air flow rate (F206). On the other hand, when the predicted temperature (F202) of the toner exceeds the threshold temperature T3, the air flow rate is set to M2 which indicates the maximum air flow rate and printing is resumed (F207).

As described above, in the present embodiment, it is also possible to avoid an air flow rate change of the fan during printing by increasing air flow rate of the cooling fan prior to the image forming. In the first embodiment, it is possible to suppress the quality difference between printed materials and to maintain productivity as well as to reduce operational sound by reducing an error between an actual temperature and a predicted temperature by suppressing an air flow rate change during operation.

In the second embodiment, during the non image forming operation prior to the image forming operation, when the temperature is equal to or higher than the first temperature (the threshold temperatures T1, T3), the cooling fan 80 is started to be driven or the air flow rate is increased to the second rate M2 (second flow rate) which is higher than the first rate M1 (first flow rate). On the other hand, during the image forming operation, when the temperature is equal to or higher than the second temperature (the threshold temperature T4), the cooling fan 80 is started to be driven.

Other Embodiments

In the above embodiments, although the cooling fan 80 has two steps or three steps of air flow rates selected from M0 (zero air flow rate), M1 (half of the maximum air flow rate of the fan), M2 (the maximum air flow rate of the fan), the invention is not limited thereto and it is sufficient to have plurality of stepwise air flow rates. An air flow rate of each step and the number of steps are arbitrary and the present invention can be realized if the cooling fan 80 has at least two steps of air flow rates. The method for changing the air flow rate is not limited to the pulse width modulation.

Further, in the embodiments described above, a new threshold value is provided at the time when the image forming process is started but the present invention is not limited thereto. That is, whether a new threshold is provided in any air flow rate or not is arbitrary. For example, only one among the plurality of threshold temperatures may be changed with a new threshold temperature and a new threshold temperature may be different upon each setting.

In the embodiments described above, the air flow rate is controlled based on sensing results of a plurality of temperature sensors. The present invention may be applied to a configuration in which just one temperature sensor is provided. In that case, the threshold temperature during an image formation operation is set to be higher than that during non image forming operation.

According to the above configurations, it is possible to achieve both suppression of quality difference between printed materials and maintenance of productivity by suppressing the difference between the predicted temperature and the actual temperature due to an air flow rate change of the cooling fan.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-036240, filed Feb. 27, 2014 which is hereby incorporated by reference herein in its entirety.

What is claimed is:

1. An image forming apparatus, comprising:

an image bearing member;

a developing device configured to develop with toner an electrostatic latent image formed on the image bearing member;

a first temperature detecting unit configured to detect temperature;

a second temperature detecting unit configured to detect temperature;

a cooling unit configured to cool the inside of the image forming apparatus by blowing; and a controller which controls an operation of the cooling unit based on temperature information obtained from a detection result of the first temperature detecting unit and a detection result of the second temperature detecting unit, wherein the controller changes the flowing amount of the cooling unit from a first flowing amount to a second flowing amount when the temperature information reaches a first temperature level before starting an image forming job to form an image on a recording medium, and wherein the controller maintains a condition of the cooling unit just before starting the image forming job until the temperature information reaches a second temperature level which is higher than the first temperature level, and in a status in which the cooling unit is being driven at the first flowing amount, when the temperature information reaches the second temperature level, the controller changes the flowing amount of the cooling unit to the second flowing amount from the first flowing amount.

2. The image forming apparatus according to claim 1, wherein the second temperature level is set to a temperature which is lower than a temperature at which toner aggregates in the developing device increase.

3. The image forming apparatus according to claim 1, wherein the first temperature detecting unit is configured to detect an ambient temperature of the developing device, and the second temperature detecting unit is configured to detect atmospheric temperature at a location that is disposed further apart from the developing device than the first temperature detecting unit.

4. An image forming apparatus, comprising:

an image bearing member;

a developing device configured to develop with toner an electrostatic latent image formed on the image bearing member;

a first temperature detecting unit configured to detect temperature;

a second temperature detecting unit configured to detect temperature;

a cooling unit configured to cool the inside of the image forming apparatus by blowing; and a controller which controls an operation of the cooling unit based on temperature information obtained from a detection result of the first temperature detecting unit and a detection result of the second temperature detecting unit, wherein before starting an image forming job to form an image on a recording medium, the controller stops driving of the cooling unit in a case that the temperature information is lower than a first temperature level and starts driving of the cooling unit in a case that the temperature information reaches the first temperature level, and wherein during the image forming job, the controller maintains a condition of the cooling unit just before starting the image forming job when the temperature information is lower than a second temperature level which is higher than the first temperature level, and during the image forming job, if the temperature information reaches the second temperature level in a status in which driving of the cooling unit is stopped, the controller starts driving of the cooling unit.

5. The image forming apparatus according to claim 4, wherein the second temperature level is set to a temperature which is lower than a temperature at which toner aggregates in the developing device increase.

6. The image forming apparatus according to claim 4, wherein the first temperature detecting unit is configured to detect an ambient temperature of the developing device, and the second temperature detecting unit is configured to detect atmospheric temperature at a location that is disposed further apart from the developing device than the first temperature detecting unit.

7. An image forming apparatus, comprising:

an image bearing member;

a developing device configured to develop with toner an electrostatic latent image formed on the image bearing member;

a temperature detecting unit configured to detect temperature;

a cooling unit configured to cool the inside of the image forming apparatus by blowing; and a controller which controls an operation of the cooling unit based on temperature information obtained from a detection result of the temperature detecting unit, wherein the cooling unit is configured to switch a flowing amount of the cooling unit per unit time between a first flowing amount and a second flowing amount which is greater than the first flowing amount, wherein the controller changes the flowing amount of the cooling unit from the first flowing amount to the second flowing amount when the temperature information reaches a first temperature level before starting an image forming job to form an image on a recording medium, and wherein the controller maintains a condition of the cooling unit just before starting the image forming job until the temperature information reaches a second temperature level which is higher than the first temperature level, and in a status in which the cooling unit is being driven at the first flow amount, when the temperature information reaches the second temperature level, the controller changes the flowing amount of the cooling unit to the second flowing amount from the first flowing amount.

8. The image forming apparatus according to claim 7, wherein the second temperature level is set to a temperature which is lower than a temperature at which toner aggregates in the developing device increase.

9. The image forming apparatus according to claim 7, wherein the temperature detecting unit is configured to detect an ambient temperature of the developing device.

10. An image forming apparatus, comprising:

an image bearing member;

a developing device configured to develop with toner an electrostatic latent image formed on the image bearing member;

a temperature detecting unit configured to detect temperature;

a cooling unit configured to cool the inside of the image forming apparatus by blowing; and a controller which controls an operation of the cooling unit based on temperature information obtained from a detection result of the temperature detecting unit, wherein before starting an image forming job to form an image on a recording medium, the controller stops driving of the cooling unit in a case that the temperature information is lower than a first temperature level and starts driving of the cooling unit in a case that the temperature information reaches the first temperature level, and wherein during the image forming job, the controller maintains a condition of the cooling unit just before starting the image forming job when the temperature information is lower than a second temperature level which is higher than the first temperature level, and during the image forming job, if the temperature information reaches the second temperature level in a status in which driving of the cooling unit is stopped, the controller starts driving of the cooling unit.

11. The image forming apparatus according to claim 10, wherein the second temperature level is set to a temperature which is lower than a temperature at which toner aggregates in the developing device increase.

12. The image forming apparatus according to claim 10, wherein the temperature detecting unit is configured to detect an ambient temperature of the developing device.

13. An image forming apparatus, comprising:

a developing device configured to develop with toner an electrostatic latent image formed on an image bearing member;

a ventilating device to ventilate the developing device with outside air; and a controller which controls the ventilating device, wherein when the ventilating device is not driven and the controller receives an image forming start signal, the controller starts driving the ventilating device after the image forming start signal is received and before an image forming process starts, in a case that a toner temperature in the developing device is higher than a first predetermined temperature, and when the ventilating device is not driven during the image forming process, the controller starts driving the ventilating device, in a case that the toner temperature in the developing device is higher than a second predetermined temperature, which is higher than the first predetermined temperature.

14. An image forming apparatus, comprising:

a developing device configured to develop with toner an electrostatic latent image formed on an image bearing member;

a temperature sensor detecting temperature around the developing device;

a ventilating device to ventilate the developing device with outside air; and a controller which controls the ventilating device, wherein when the ventilating device is not driven and the controller receives an image forming start signal, the controller starts driving the ventilating device after the image forming start signal is received and before an image forming process starts, in a case that a temperature regarding toner in the developing device obtained by the temperature sensor is higher than a first predetermined temperature, and when the ventilating device is not driven during the image forming process, the controller starts driving the ventilating device, in a case that the temperature regarding toner in the developing device obtained by the temperature sensor is higher than a second predetermined temperature, which is higher than the first predetermined temperature.

15. An image forming apparatus, comprising:

a developing device configured to develop with toner an electrostatic latent image formed on an image bearing member;

a first temperature sensor detecting temperature around the developing device;

a second temperature sensor detecting temperature around the developing device at a position further than that of the first temperature sensor from the developing device;

a ventilating device to ventilate the developing device with outside air; and a controller which controls the ventilating device, wherein when the ventilating device is not driven and the controller receives an image forming start signal, the controller starts driving the ventilating device after the image forming start signal is received and before an image forming process starts, in a case that a temperature regarding toner in the developing device obtained by the first temperature sensor and the second temperature sensor is higher than a first predetermined temperature, and when the ventilating device is not driven during the image forming process, the controller starts driving the ventilating device, in a case that the temperature regarding toner in the developing device obtained by the first temperature sensor and the second temperature sensor is higher than a second predetermined temperature, which is higher than the first predetermined temperature.

16. The image forming apparatus, according to the claim 15, wherein the temperature regarding toner in the developing device is obtained based on a difference between a detection result of the first temperature sensor and a detection result of the second temperature sensor.

17. An image forming apparatus, comprising:

a developing device configured to develop with toner an electrostatic latent image formed on an image bearing member;

a ventilating device to ventilate the developing device with outside air; and a controller which controls the ventilating device, wherein when the ventilating device is not driven during an image forming process, the controller starts driving the ventilating device in a case that a toner temperature in the developing device is higher than a first predetermined temperature, and when the ventilating device is not driven at a time after the image forming process finishes, the controller starts driving the ventilating device in a case that the toner temperature in the developing device is higher than a second predetermined temperature, which is lower than the first predetermined temperature.

18. An image forming apparatus, comprising:

a developing device configured to develop with toner an electrostatic latent image formed on an image bearing member;

a temperature sensor detecting temperature around the developing device;

a ventilating device to ventilate the developing device with outside air; and a controller which controls the ventilating device, wherein when the ventilating device is not driven during an image forming process, the controller starts driving the ventilating device after an image forming start signal is received and before an image forming process starts, in a case that a temperature regarding toner in the developing device obtained by the temperature sensor is higher than a first predetermined temperature, and when the ventilating device is not driven at a time after the image forming process finishes, the controller starts driving the ventilating device, in a case that the temperature regarding toner in the developing device obtained by the temperature sensor is higher than a second predetermined temperature, which is lower than the first predetermined temperature.

19. An image forming apparatus, comprising:

a developing device configured to develop with toner an electrostatic latent image formed on an image bearing member;

a first temperature sensor detecting temperature around the developing device;

a second temperature sensor detecting temperature around the developing device at a position further than that of the first temperature sensor from the developing device;

a ventilating device to ventilate the developing device with outside air; and a controller which controls the ventilating device, wherein when the ventilating device is not driven during an image forming process, the controller starts driving the ventilating device after the image forming start signal is received and before an image forming process starts, in a case that a temperature regarding toner in the developing device obtained by the first temperature sensor and the second temperature sensor is higher than a first predetermined temperature, and when the ventilating device is not driven at a time after the image forming process finishes, the controller starts driving the ventilating device, in a case that the temperature regarding toner in the developing device obtained by the first temperature sensor and the second temperature sensor is higher than a second predetermined temperature, which is lower than the first predetermined temperature.

20. The image forming apparatus according to the claim 19, wherein the temperature regarding toner in the developing device is obtained based on a difference between a detection result of the first temperature sensor and a detection result of the second temperature sensor.

* * * * *